US009435607B1

(12) United States Patent
Moushon et al.

(10) Patent No.: US 9,435,607 B1
(45) Date of Patent: Sep. 6, 2016

(54) SHOTGUN WITH ADJUSTABLE SHELL LOADING CAPACITY

(71) Applicants: Gaylan Wayne Moushon, Washington, IL (US); Dwayne Lynn Atherton, Spring Bay, IL (US); Scott E. Meixsell, Spring Bay, IL (US)

(72) Inventors: Gaylan Wayne Moushon, Washington, IL (US); Dwayne Lynn Atherton, Spring Bay, IL (US); Scott E. Meixsell, Spring Bay, IL (US)

(73) Assignee: Gaylan Wayne Moushon, Washington, IL (US)

( * ) Notice: Subject to any disclaimer, the term of this patent is extended or adjusted under 35 U.S.C. 154(b) by 0 days.

(21) Appl. No.: 14/822,296

(22) Filed: Aug. 10, 2015

(51) Int. Cl.
*F41A 9/71* (2006.01)
*F41C 7/02* (2006.01)

(52) U.S. Cl.
CPC ... *F41C 7/02* (2013.01); *F41A 9/71* (2013.01)

(58) Field of Classification Search
CPC ..... F41C 7/02; F41A 9/70; F41A 9/71; F41A 9/72; F41A 9/63
USPC ..... 42/17, 7, 49.01, 49.02; 89/33.1
See application file for complete search history.

(56) References Cited

U.S. PATENT DOCUMENTS 1,061,787 A * 5/1913 Simpson ..... F41A 9/72 42/49.01
1,245,499 A * 11/1917 Orme ..... F41A 9/67 124/52
1,702,221 A * 2/1929 Parsons ..... F41A 9/72 42/17
2,129,729 A * 9/1938 Blizard ..... F41A 9/72 42/49.02
3,371,440 A * 3/1968 Cassell ..... F41A 9/72 42/106
3,777,383 A * 12/1973 Haines ..... F41A 9/72 42/49.02
5,309,660 A * 5/1994 Blackamore ..... F42B 33/14 42/106
8,887,428 B1 * 11/2014 Lemoine ..... F41A 9/61 42/49.01
2014/0250751 A1 * 9/2014 Foster ..... F41A 9/55 42/6
2016/0061546 A1 * 3/2016 Shade ..... F41A 9/71 42/49.02

* cited by examiner

*Primary Examiner* — Samir Abdosh
*Assistant Examiner* — John D Cooper
(74) *Attorney, Agent, or Firm* — Miller, Matthias & Hull LLP

(57) ABSTRACT

A shotgun may comprise a barrel, a chamber configured to receive a shell prior to being fired from the shotgun, and a magazine tube configured to hold shells to be introduced into the chamber. The shotgun may further comprise a shell follower configured for insertion into the magazine tube axially forward of the shells with respect to the long axis of the magazine tube. In addition, the shotgun may further comprise an obstruction associated with the magazine tube that is adjustable between a first position in which the obstruction blocks a travel of the shell follower axially forward of the obstruction, and a second position in which the obstruction allows the travel of the shell follower axially forward of the obstruction. The shell loading capacity of the shotgun may be lower when the obstruction is in the first position than when the obstruction is in the second position.

12 Claims, 9 Drawing Sheets

SHOTGUN WITH ADJUSTABLE SHELL LOADING CAPACITY

TECHNICAL FIELD

The present disclosure generally relates to shotguns and, more specifically, to shotguns having a shell loading capacity that may be adjusted by a user.

BACKGROUND

Shotguns are a type of firearm that fire shells containing small pellets called shots, or solid projectiles called slugs. Shotguns are most commonly available in three configurations that are defined by how the weapon is loaded: a pump shotgun, a semi-automatic shotgun, and a break-action shotgun. A "pump" shotgun is loaded when the user cycles a sliding forearm to the rear and then forward again. This action ejects a fired shell casing from the chamber and loads a new shell from the magazine tube into the chamber. A "semi-automatic" shotgun cycles this ejection and loading process automatically for the user. A "break-action" shotgun has no magazine and is opened by the user who manually unloads and loads a single shell.

This disclosure relates to pump, semi-automatic, or any other shotgun configuration in which a magazine is employed. Such shotguns may generally include the following components: a barrel through which the shells are fired; a receiver through which the barrel is slidably or otherwise received; a chamber in which a shell is held prior to being fired from the barrel; a magazine tube in which shells are held in spring tension prior to introduction into the chamber; and a forearm that may be pulled to the rear of the shotgun to eject an old shell and load a new shell into the chamber (if the shotgun is a "pump" shotgun), as well as several other features. In practice, the barrel may be assembled onto the shotgun by sliding the back end of the barrel into the receiver and sliding a downwardly-extending ring of the barrel over the magazine tube. The barrel may then be locked in position with a cap that engages with an open end of the magazine tube and prevents the barrel from coming off of the weapon. In this way, the barrel of a shotgun may be exchanged so the shotgun can be used for different purposes.

Government regulations may dictate the shell loading capacity of a shotgun based on its intended application. Specifically, these regulations may specify the maximum number of rounds or shells that can be loaded into the magazine tube for each specific type of application of the shotgun. For example, for hunting upland game birds, the maximum allowable number of shells that can be loaded into the magazine tube of the shotgun may be three (two in the magazine tube and one in the chamber), while for home protection purposes the restriction to three rounds may be lifted, although such regulations may vary depending on the state. In order to avoid the need for different shotguns or magazine tubes with different shell loading capacities for various applications, shotgun users have sought strategies that permit the adjustment of the shell loading capacity of the magazine tube.

A common approach to control the shell loading capacity of a shotgun magazine tube is the use of a "plug" which is a device that occupies space in the magazine tube and limits the number of shells that can be loaded into the magazine tube. For example, U.S. Pat. No. 3,371,440 discloses a plug for removable insertion into a magazine tube to reduce the loading capacity of the magazine tube when hunting migratory birds. Although effective, a user must either disassemble the weapon to remove the plug and/or reassemble with a larger capacity magazine tube when using the shotgun for applications having lifted shell capacity regulations.

Another approach is to attach an add-on extension tube onto the open end of magazine tube to increase the shell loading capacity of the shotgun. Attachment of the extension tube onto a magazine tube of an existing shotgun may be accomplished by removing the cap from the open end of the magazine tube and connecting the open end of the extension tube to the open end of the magazine tube. However, since the cap on the open end of the magazine tube is used to secure the barrel to the shotgun, care should be taken to ensure that that the barrel is properly secured after the cap is removed and the extension tube is attached. This may be problematic with some current shotgun designs. Furthermore, in some shotgun designs, the extension tube may not rest tightly against the factory magazine tube and may not be in proper concentric alignment with the magazine tube. This may lead to a gap between the magazine tube and the extension tube in which the shells may become lodged and would thus cause a failure of the loading system.

Clearly, there is a need for more effective strategies for controlling the shell loading capacity of a shotgun for various applications.

SUMMARY

In accordance with one aspect of the present disclosure, a shotgun is disclosed. The shotgun may comprise a barrel, a chamber configured to receive a shell prior to being fired from the shotgun, and a magazine tube configured to hold shells to be introduced into the chamber. The shotgun may further comprise a shell follower configured for insertion into the magazine tube axially forward of the shells with respect to the long axis of the magazine tube. In addition, the shotgun may further comprise an obstruction associated with the magazine tube that may be adjustable between a first position in which the obstruction blocks a travel of the shell follower axially forward of the obstruction, and a second position in which the obstruction allows the travel of the shell follower axially forward of the obstruction. A shell loading capacity of the shotgun may be lower when the obstruction is in the first position than when the obstruction is in the second position.

In accordance with another aspect of the present disclosure, a kit for controlling a shell loading capacity of a shotgun is disclosed. The shotgun may include a barrel, a chamber configured to receive a shell prior to being fired from the shotgun, and a magazine tube configured to hold shells to be introduced into the chamber. The kit may comprise a shell follower configured for insertion into the magazine tube axially forward of the shells with respect to the long axis of the magazine tube, and an extension tube configured to provide an extension to the magazine tube. The kit may further comprise an extension locking assembly configured to connect the extension tube to the magazine tube, hold the extension tube in concentric alignment with the magazine tube, and lock the barrel in position on the shotgun. In addition, the kit may further comprise an obstruction configured to assemble with the shotgun at a position along the magazine tube or the extension tube. The obstruction may be adjustable between a first position in which the obstruction blocks a travel of the shell follower axially forward of the obstruction, and a second position in which the obstruction allows the travel of the shell follower axially forward of the obstruction. The shell loading capacity of the shotgun may be lower when the obstruction is in the first position than when the obstruction is in the second position.

In accordance with another aspect of the present disclosure, a kit for controlling a shell loading capacity of a shotgun is disclosed. The shotgun may include a barrel, a chamber configured to receive a shell prior to being fired from the shotgun, and a magazine tube configured to hold shells to be introduced into the chamber. The kit may comprise a shell follower having a closed end and an open end. The shell follower may be configured for insertion into the magazine tube axially forward of the shells with the closed end oriented toward the shells. The kit may further comprise a spring configured for insertion into the open end of the shell follower, an extension tube configured to provide an extension to the magazine tube, and an extension locking assembly. The extension locking assembly may be configured to connect the extension tube to the magazine tube, hold the extension tube in concentric alignment with the magazine tube, and lock the barrel in position on the shotgun. The kit may further comprise an obstruction connected to the extension locking assembly that may be configured to block a travel of the shell follower axially forward of the obstruction when in a first position and to allow the travel of the shell follower axially forward of the obstruction when in a second position. The shell loading capacity of the shotgun may be lower when the obstruction is in the first position than when the obstruction is in the second position.

These and other aspects and features of the present disclosure will be more readily understood when read in conjunction with the accompanying drawings.

It should be understood that the drawings are not necessarily drawn to scale and that the disclosed embodiments are sometimes illustrated schematically and in partial views. It is to be further appreciated that the following detailed description is merely exemplary in nature and is not intended to limit the invention or the application and uses thereof. In this regard, it is to be additionally appreciated that the described embodiment is not limited to use with shotguns but may be used with other types of firearms. Hence, although the present disclosure is, for convenience of explanation, depicted and described as certain illustrative embodiments, it will be appreciated that it can be implemented in various other types of embodiments and in various other systems and environments.

DETAILED DESCRIPTION

Figure 1:
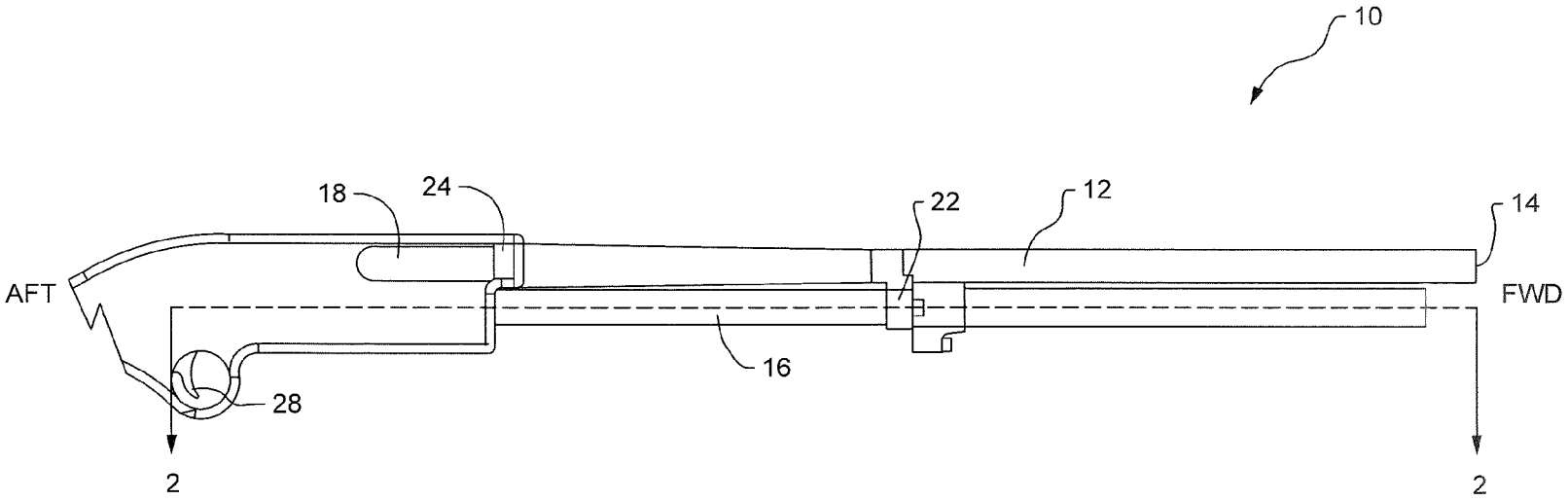
FIG. 1 is a partial side view of a shotgun, constructed in accordance with the present disclosure.
Figure 2:
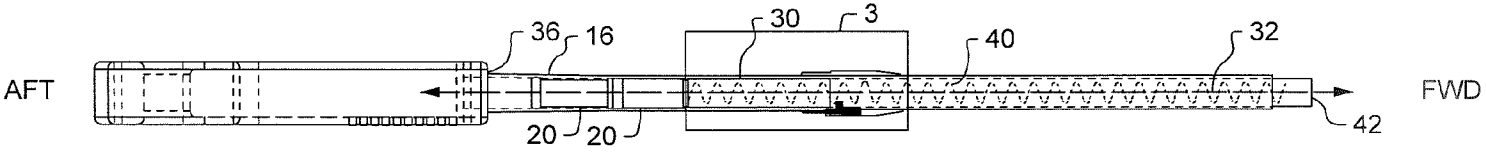
FIG. 2 is a cross-sectional view through the section 2-2 of FIG. 1, depicting contents of a magazine tube of the shotgun, constructed in accordance with the present disclosure.
Figure 3:
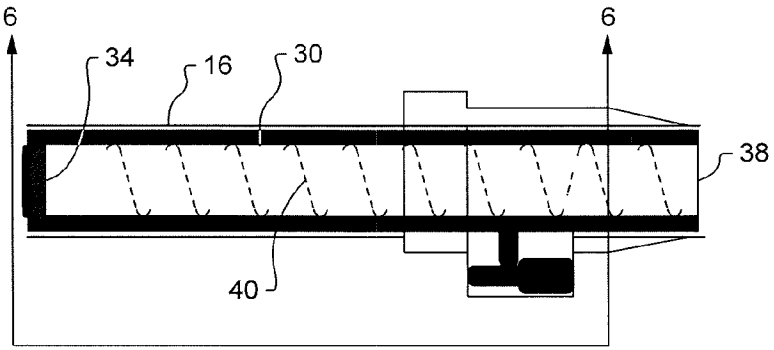
FIG. 3 is an expanded view of detail 3 of FIG. 2, depicting a shell follower in the magazine tube, constructed in accordance with the present disclosure.

Referring now to the drawings, and with specific reference to FIGS. 1-3, a shotgun 10 is shown. The shotgun 10 may be a pump shotgun, a semi-automatic shotgun, or any other type of shotgun having a magazine. The shotgun 10 may have a built-in or attachable mechanism for controlling the shell loading capacity of the shotgun 10, as will be described in further detail below. In general, the shotgun 10 may include a barrel 12 for firing shots or slugs out through a forward end 14 of the shotgun, and a magazine tube 16 below the barrel 12 in which shells 20 containing the shots or slugs may be loaded (also see FIG. 2). The shells 20 in the magazine tube 16 may be introduced one at a time into a chamber 18 which may hold a shell 20 prior to being fired from the shotgun 10. The barrel 12 may include a downwardly-extending ring 22 that is co-welded or otherwise permanently attached to the barrel 12 that slides over the magazine tube 16. The shotgun 10 may also include a receiver 24 that slidably or otherwise receives the barrel 12 such that the barrel 12 may be removed and exchanged with another type of barrel for different applications of the shotgun 10. In addition, several additional features and structures may be provided on the shotgun 10 that are well-understood by those with ordinary skill in the art, such as a trigger 28 for triggering the firing of shots or slugs from the barrel 12, and a forearm (not shown) that may be pulled to the rear of the shotgun to eject a used shell and pushed forward again to load a new shell into the chamber 18 such as if the shotgun is a "pump" shotgun.

Figure 4:
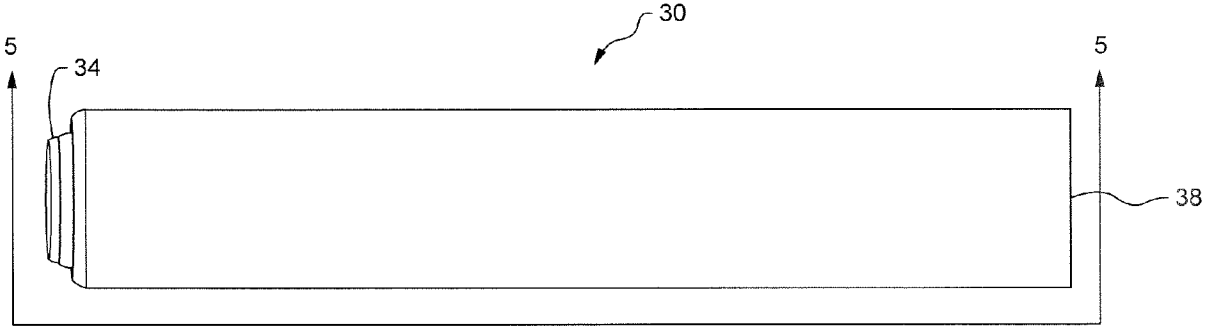
FIG. 4 is a side view of the shell follower in isolation, constructed in accordance with the present disclosure.
Figure 5:
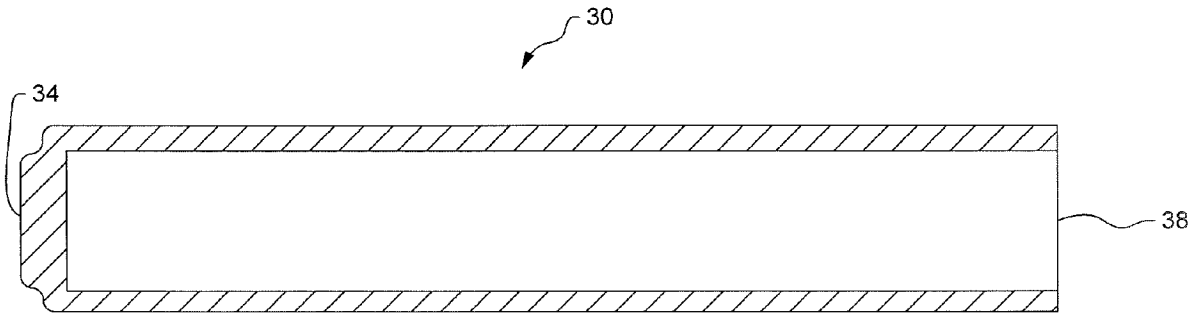
FIG. 5 is a cross-sectional view through the section 5-5 of FIG. 4, constructed in accordance with the present disclosure.

Referring to FIGS. 2-3, the shotgun 10 may also include a shell follower 30 that is loaded into the magazine tube 16 axially forward of the shells 20 with respect to a long axis 32 of the magazine tube 16. The shell follower 30 may be a tube-like structure that includes a closed end 34 oriented toward the shells 20 or an aft end 36 of the magazine tube 16, and an open end 38 on the opposing side of the shell follower 30 through which a portion of one end of a magazine return spring 40 is contained (also see FIGS. 4-5). The loading of the shells 20 into the magazine tube 16 may press against the closed end 34 of the shell follower 30. This may cause the shell follower 30 to travel axially forward along the length of the magazine tube 16 until the spring 40 reaches maximum compression, or until the open end 38 of the shell follower 30 contacts a forward end 42 of the magazine tube 16 or another type of obstruction as will be described below.

Figure 6:
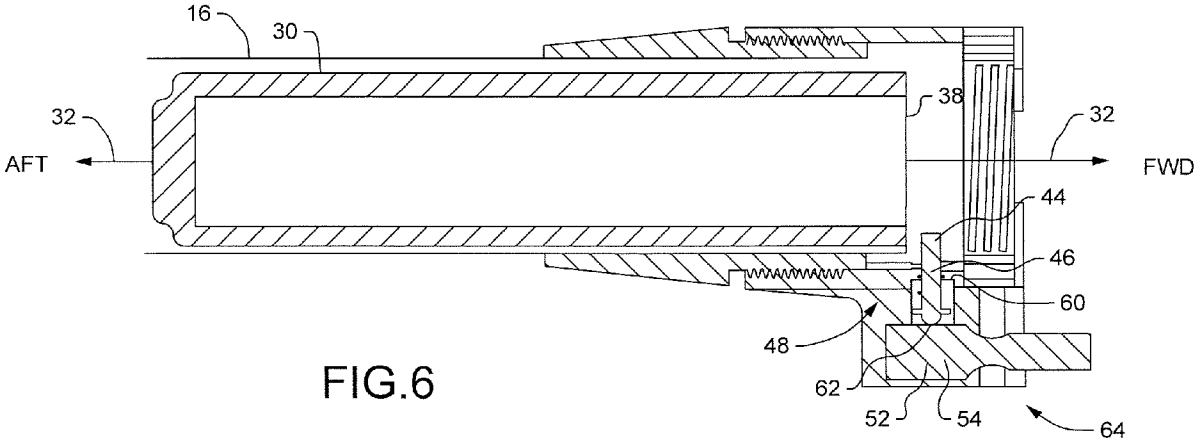
FIG. 6 is a cross-sectional view through the section 6-6 of FIG. 3, depicting the shell follower and an obstruction in a first position to reduce the shell loading capacity of the shotgun, constructed in accordance with the present disclosure.
Figure 7:
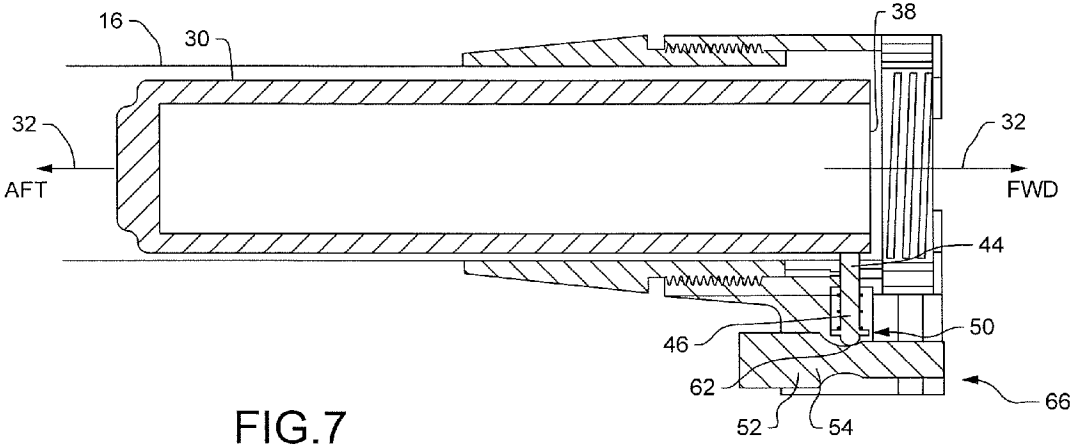
FIG. 7 is an cross-sectional view similar to FIG. 6, but with the obstruction in a second position to increase the shell loading capacity of the shotgun, constructed in accordance with the present disclosure.
Figure 9:
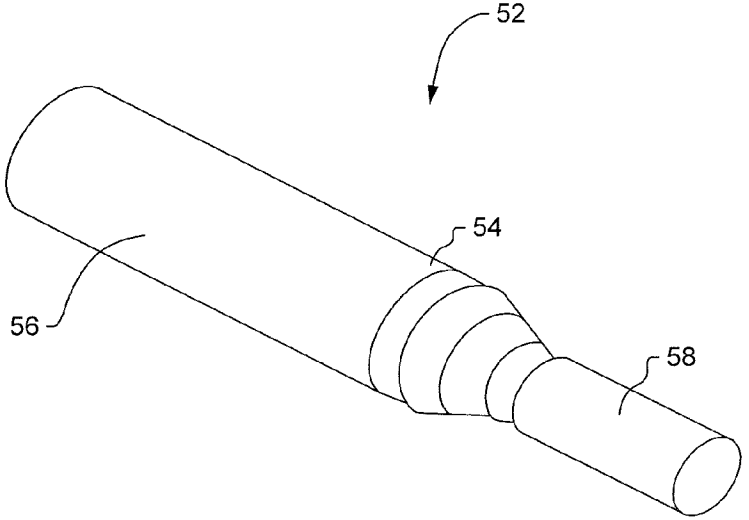
FIG. 9 is a perspective view of a selector device for adjusting the obstruction between the first position and the second position, constructed in accordance with the present disclosure.
Figure 8:
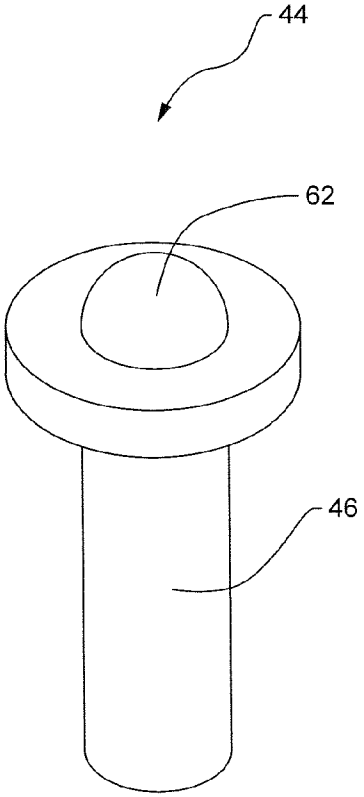
FIG. 8 is a perspective view of the obstruction shown in isolation, constructed in accordance with the present disclosure.

Turning now to FIGS. 6-9, a mechanism for controlling the shell loading capacity of the shotgun 10 in accordance with the present disclosure is shown. In particular, FIGS. 6-7 depict the mechanism of controlling the axial movement of the shell follower 30 through the magazine tube 16 with the spring 40 removed for clarity purposes. The shotgun 10 may include an adjustable obstruction 44 that regulates the travel of the shell follower 30, and therefore, the shell loading capacity of the shotgun 10 without interfering with the motion of the spring 40. In one aspect of the present disclosure, the obstruction 44 may be a pin 46 (also see FIG. 8) that may be inserted and retracted perpendicularly into the magazine tube 16 with respect to the long axis 32 of the magazine tube 16, although other types of obstructions may also be used. Specifically, the obstruction 44 may be adjustable by a user between a first position 48 (FIG. 6) in which the obstruction is inserted into the magazine tube 16 to block the travel of the shell follower 30 axially forward of the obstruction 44, and a second position 50 (FIG. 7) in which the obstruction 44 is retracted from the magazine tube 16 to allow the shell follower 30 to travel axially forward of the obstruction 44. In the second position 50, the shell follower 30 may travel axially forward of the obstruction 44 until the open end 38 reaches another obstruction (such as the forward end 42 of the magazine tube 16) or until the spring 40 reaches maximum compression. In another embodiment, the obstruction need not be provided in the form of spring-biased pin, but rather can be provided in the form of a threaded screw that is rotated one way to introduce the obstruction into the magazine tube, and rotated in an opposite direction to remove the obstruction from the magazine tube. Other embodiments are certainly possible.

Thus, the shell loading capacity of the shotgun 10 may be lower when the obstruction 44 is in the first position 48 than when the obstruction 44 is in the second position 50, as fewer shells 20 may be loaded into the magazine tube 16 when the travel of the shell follower 30 is blocked. This may allow the user to select between a lower shell loading capacity and a higher shell loading capacity by selecting the position of the obstruction 44 without disassembling, adding on, or removing any part of the shotgun 10. For example, the user may select the higher shell loading capacity of the shotgun 10 (i.e., the second position 50 of the obstruction 44) when using the shotgun 10 for applications having lifted shell loading restrictions such as for hunting non-protected species, target practicing, or home protection purposes.

Alternatively, the user may select the lower shell loading capacity of the shotgun 10 (i.e., the first position 48 of the obstruction 44) when using the shotgun 10 for applications with stricter shell loading limitations such as upland game bird hunting. It will be understood that the lower shell loading capacity and the higher shell loading capacity of the shotgun 10 may vary depending on a number of factors such as the size of the shells, the length of the magazine tube 16, the length of the shell follower 30, the position of the obstruction 44 along the length of the magazine tube 16, and the compressibility of the spring 40. It is also noted that the lower shell loading capacity of the shotgun is also controlled, in part, by the length of the shell follower 30. In one aspect of the present disclosure, the length of the shell follower 30 is fixed such that only two shells can be loaded into the magazine tube 16 when the obstruction is in the first position 48, regardless of the size of the shells 20. This feature of the shell follower 30 is of significant value since the law dictates the number of shells, not the size/length of each individual shell.

The shotgun 10 may further include a selector device 52 (FIGS. 6-9) operatively associated with the obstruction 44 to control the position of the obstruction 44. The selector device 52 may be at least partially exposed on the outside of the magazine tube 16 such that a user may access the selector device 52 to select the position of the obstruction 44. As a non-limiting possibility, the selector device 52 may be a tapered shaft 54 oriented parallel or at least substantially parallel to the magazine tube 16 that may be slid axially back and forth with respect to the long axis 32 to adjust the position of the obstruction 44, as shown in FIGS. 6-7. The tapered shaft 54 may have a wider diameter region 56 on one end of the shaft 54, and a narrower diameter region 58 on an opposing end of the shaft 54 (see FIG. 9). In addition, the pin 46 may be spring-biased with a spring 60 and it may include a head 62 (also see FIG. 8) that rides against the tapered shaft 54 and remains fixed axially as the tapered shaft 54 is slid axially aft or forward. For example, the tapered shaft 54 may be slid axially forward to a first position 64 (FIG. 6) in which the wider diameter region 56 pushes the pin 46 upward perpendicularly into the magazine tube 16 to the first position 48 and compresses the spring 60. Alternatively, the tapered shaft 54 may be slid axially aft to a second position 66 (FIG. 7) in which the narrower diameter region 58 may allow the spring 60 to expand to retract the pin 46 from the magazine tube 16 to the second position 50. However, various other types of devices may be used to control the position of the obstruction 44 such as a turn knob, a switch, a lever, a threaded screw, or other such devices.

Figure 10:
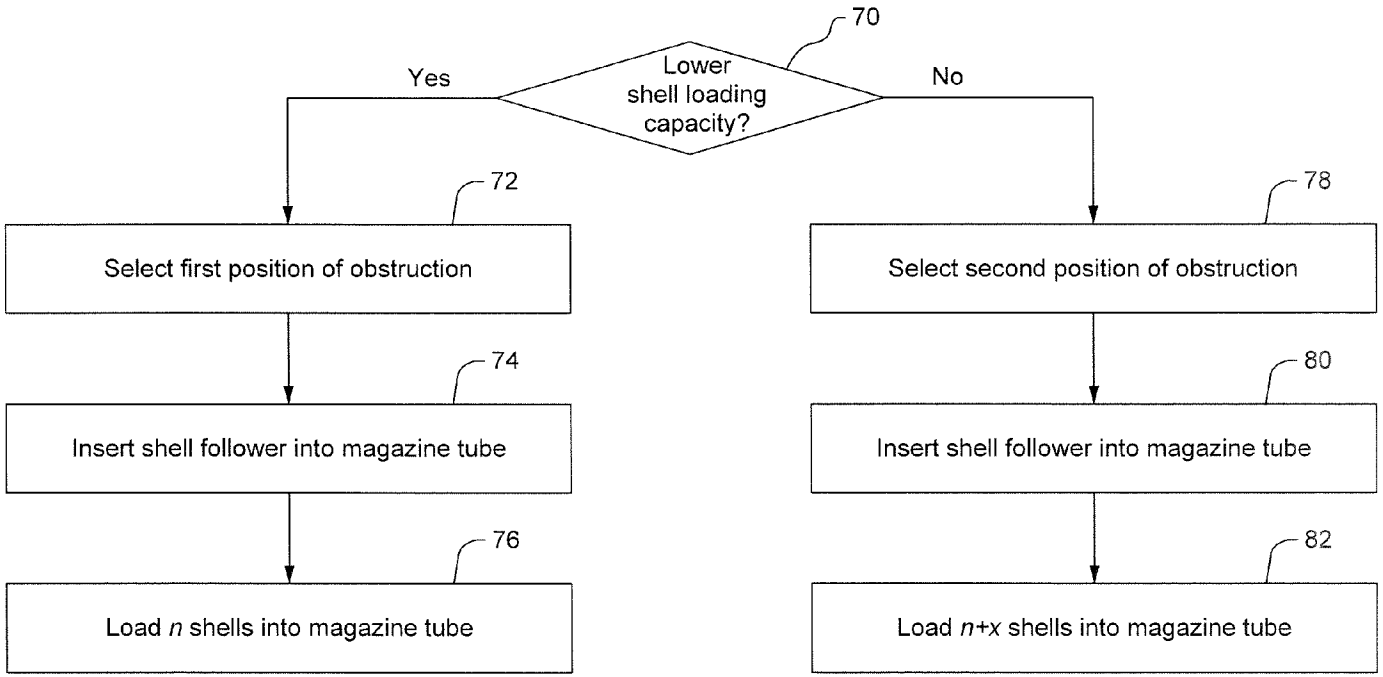
FIG. 10 is a flowchart of a series of steps that may be involved in controlling the shell loading capacity of the shotgun, constructed in accordance with a method of the present disclosure.

A series of steps that may be involved in controlling the shell loading capacity of the shotgun 10 using the shell follower 30 and the obstruction 44 are shown in FIG. 10. Beginning with a first block 70, a user may choose between the lower shell loading capacity and the higher shell loading capacity of the shotgun 10 depending on the shell loading restrictions of the intended application. If a lower shell loading capacity is desired, the user may select the first position 48 of the obstruction 44 by adjusting the selector device 52 accordingly (block 72). The shell follower 30 may be inserted into the magazine tube 16 with the closed end 34 oriented toward the aft end 36 of the magazine tube 16 (block 74), and the shells 20 may be loaded into the magazine tube 16 axially aft of the shell follower 30 (block 76) to cause the shell follower 30 to be pushed axially forward through the magazine tube 16 until the open end 38 of the shell follower 30 reaches the obstruction 44. Therefore, the number (n) of the shells 20 that may be loaded into the magazine tube 16 during the block 76 is limited by the obstruction 44.

Alternatively, if a higher shell loading capacity is desired, the user may select the second position 50 of the obstruction 44 by adjusting the selector device 52 accordingly (block 78). The shell follower 30 may then be inserted into the magazine tube 16 with the closed end 34 oriented toward the aft end 36 of the magazine tube 16 (block 80), and the shells 20 may be loaded into the magazine tube 16 axially aft of the shell follower 30 (block 82) to push the shell follower 30 axially forward until the open end 38 of the shell follower 30 reaches the forward end 42 of the magazine tube 16 (or a forward end of an extension tube if an extension tube is attached to the magazine tube) or until the spring 40 is maximally compressed. In this case, the number of the shells 20 that may be loaded into the magazine tube 16 is limited by the length of the magazine tube 16 (including the length of an extension tube if an extension tube is used) and is given by n+x, where x is a positive integer.

Figure 11:
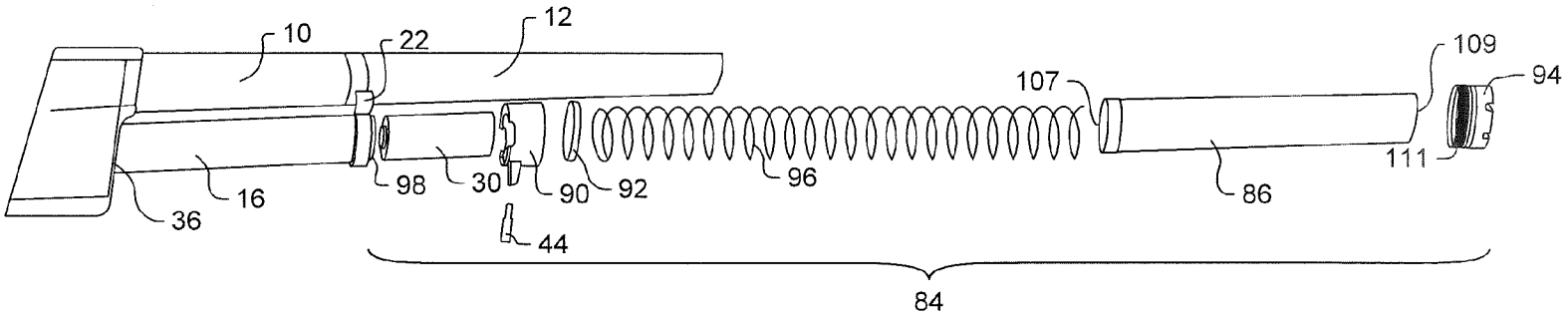
FIG. 11 is an exploded view showing components of a kit for controlling a shell loading capacity of a shotgun, constructed in accordance with the present disclosure.
Figure 12:
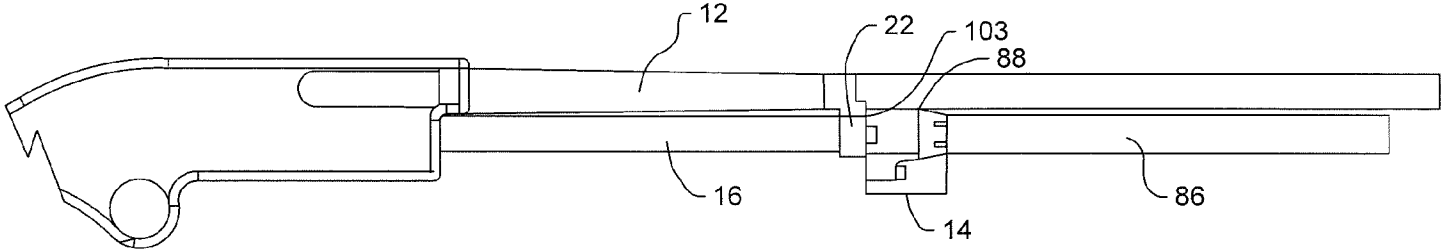
FIG. 12 is a partial side view showing the components of the kit of FIG. 11 after assembly on the shotgun, constructed in accordance with the present disclosure.
Figure 14:
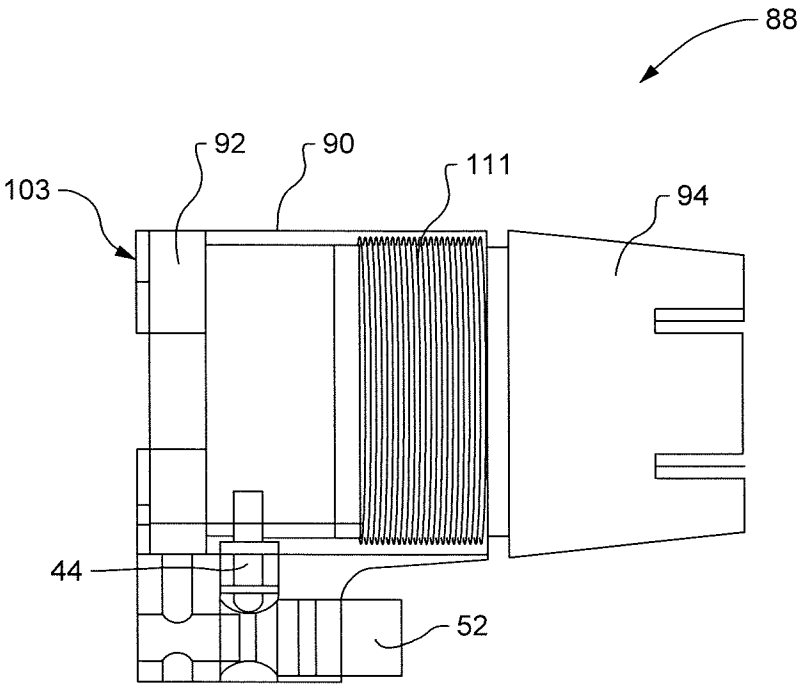
FIG. 14 is an expanded view of detail 14 of FIG. 12, depicting an extension locking assembly with an extension retaining ring being transparent to illustrate some of the internal features of the extension locking assembly, constructed in accordance with the present disclosure.

Turning now to FIGS. 11-12, a kit 84 containing various components that may be added onto or retrofit to an existing shotgun 10 to control the shell loading capacity of the shotgun 10 are shown. Namely, the components of the kit 84 may be an add-on feature for an existing shotgun to both provide an extended-length magazine tube, and to allow the control of the shell loading capacity of the shotgun 10 using the shell follower 30 and the obstruction 44 as described above. In general, the kit 84 may include the shell follower 30, an extension tube 86 to extend the length of the magazine tube 16, and an extension locking assembly 88 (see FIGS. 12 and 14) to connect the extension tube 86 to the magazine tube 16 as will be described in further detail below. In particular, the extension locking assembly 88 may include an extension retaining ring 90, a barrel locking collar 92, and an extension locking ring 94 which assemble together to connect the magazine tube 16 and the extension tube 86 (also see FIG. 14 and further details below). In addition, the kit 84 may further include the obstruction 44, such as the pin 46, and a spring 96 for spring loading the shell follower 30 and the shells 20 in the magazine tube 16 and the extension tube 86.

Figure 13:
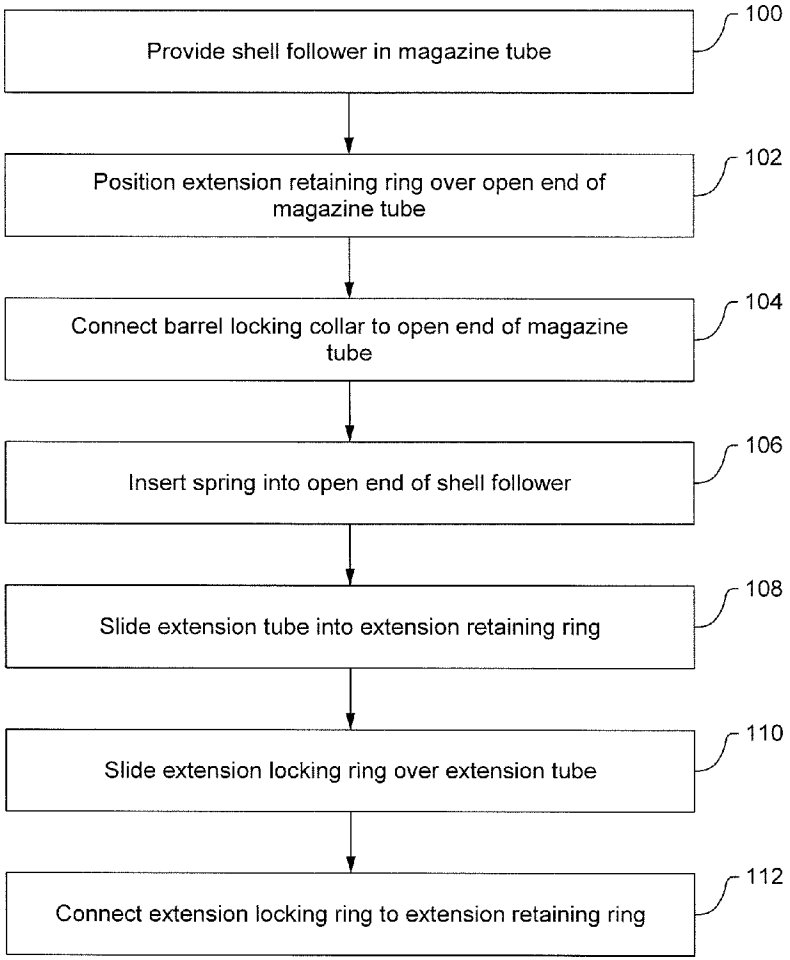
FIG. 13 is a flowchart of a series of steps that may be involved in assembling the components of the kit onto the shotgun, constructed in accordance with a method of the present disclosure.

The components of the kit 84 may be assembled onto the shotgun 10 according to the steps shown in FIG. 13. Beginning with a first block 100, the shell follower 30 may be inserted into the magazine tube 16 through an open end 98 of the magazine tube 16 (see FIG. 11) such that the closed end 34 of the shell follower 30 is oriented toward the aft end 36 of the magazine tube 16. In this regard, it will be understood that the cap on the open end 98 of the magazine tube 16 may be removed prior to the block 100 to allow the insertion of the shell follower 30 into the magazine tube 16. The extension retaining ring 90 of the extension locking assembly 88 may then be slid over the open end 98 of the magazine tube according to a next block 102 such that a shoulder 103 of the extension retaining ring 90 abuts the downwardly-extending ring 22 of the barrel 12 (also see FIG. 12). The barrel locking collar 92 may then be connected to the open end 98 of the magazine tube 16 by inserting the barrel locking collar 92 into the extension retaining ring 90 and threadably engaging the barrel locking collar 92 with the open end 98 of the magazine tube 16 (block 104). In this way, the barrel locking collar 92 may tighten the shoulder 103 of the extension retaining ring 90 against the downwardly-extending ring 22 of the barrel 12 to ensure that the barrel is secured to the shotgun 10 (see FIGS. 12 and 14). Thus, the extension retaining ring 90 and the barrel locking collar 92 may cooperate to secure the barrel to the shotgun 10, thereby fulfilling the function of the cap that was removed from the open end 98 of the shotgun 10. It is also noted that the extension retaining ring 90 may be connected to both the obstruction 44 and the selector device 52 (see FIG. 14), such that the obstruction 44 and the selector device 52 may be assembled onto the shotgun 10 along with the extension retaining ring 90. However, in other arrangements, the obstruction 44 and the selector device 52 may be assembled with the shotgun 10 separately from the extension retaining ring 90 at other positions along the length of the magazine tube 16 or the extension tube 86.

One end of the spring 96 may then be inserted into the open end 38 of the shell follower 30 according to a next block 106. In addition, an open end 107 of the extension tube 86 may be slid into the extension retaining ring 90 (block 108), and the extension locking ring 94 may be slid over a closed end 109 of the extension tube 86 and toward the extension retaining ring 90 (block 110). The extension locking ring 94 may then be connected to the extension retaining ring 90 by threadably engaging a threaded end 111 of the extension locking ring 94 with internal threads provided inside of the extension retaining ring 90 according to a block 112 (also see FIG. 14). In this way, the components of the extension locking assembly 88 (the extension retaining ring 90, the barrel locking collar 92, and the extension locking ring 94) may cooperate to hold the extension tube 86 tightly against the magazine tube 16 to prevent a gap between the extension tube 86 and the magazine tube 16. In addition, the components of the extension locking assembly 88 may also cooperate to secure the extension tube 86 in concentric alignment with the magazine tube 16.

Once the components of the kit 84 are assembled onto the shotgun 10, the shell loading capacity of the shotgun may be adjusted as shown in FIG. 10 and described above.

INDUSTRIAL APPLICABILITY

In general, it can therefore be seen that the technology disclosed herein has industrial applicability in a variety of settings such as, but not limited to, the regulation of the loading capacity of firearms. The technology disclosed herein provides a unique strategy to allow a user to adjust the shell loading capacity of a shotgun to meet varying shell loading capacity regulations for different applications. More specifically, the shotgun may be provided with a shell follower, an adjustable obstruction that controls the travel of the shell follower in the magazine tube as well as the number of shells that can be loaded into the magazine tube, and a selector device that allows the user to control the position of the obstruction. Using the selector device, a user may selectably adjust the obstruction between a first position in which the obstruction blocks the travel of the shell follower to provide a lower shell loading capacity, and a second position in which the obstruction is retracted from the magazine tube to allow the shell follower to travel along the length of the magazine tube, thereby providing a higher shell loading capacity. In this way, the user may adjust the shell loading capacity of the shotgun for different applications without the need to disassemble the weapon.

In one aspect of the present disclosure, the shell follower, the obstruction, and the selector device for may be incorporated as built-in features of a newly designed shotgun. In another aspect of the present disclosure, the shell follower, the obstruction, the selector device, a magazine extension tube, and an extension locking assembly may be provided as add-on components for an existing shotgun to allow control over the shell loading capacity of the shotgun. As disclosed herein, the extension locking assembly is designed to carry the obstruction and the selector device, as well as to secure the barrel onto the shotgun. Moreover, the extension locking assembly is also designed to hold the extension tube in proper concentric alignment with the magazine tube and to prevent a gap between the magazine tube and the extension tube. The technology disclosed herein may find wide industrial applicability in a wide range of areas such as, but not limited to, shotguns as well as other types of firearms.

What is claimed is:

1. A shotgun comprising:

a barrel;

a chamber configured to receive a shell prior to being fired from the shotgun;

a magazine tube configured to hold shells to be introduced into the chamber;

a shell follower configured for insertion into the magazine tube axially forward of the shells with respect to the long axis of the magazine tube; and an obstruction associated with the magazine tube that is adjustable between a first position in which the obstruction blocks a travel of the shell follower axially forward of the obstruction, and a second position in which the obstruction allows the travel of the shell follower axially forward of the obstruction, a shell loading capacity of the shotgun being lower when the obstruction is in the first position than when the obstruction is in the second position, the obstruction configured to allow operation of the shotgun in both the first and second positions.

2. The shotgun of claim 1, wherein the adjustment of the obstruction between the first the first position and the second position is configured to be controlled by a user without disassembling the shotgun.

3. The shotgun of claim 1, further comprising a selector device operatively associated with the obstruction that permits a user to select between the first position and the second position.

4. The shotgun of claim 3, wherein the obstruction is a pin, and wherein the pin is inserted perpendicularly into the magazine tube with respect to the long axis in the first position, and is retracted perpendicularly from the magazine tube with respect to the long axis in the second position.

5. The shotgun of claim 4, wherein the selector device is a tapered shaft that includes a wider diameter region and a narrower diameter region, and wherein the tapered shaft is capable of being slid axially by the user between a first position in which the wider diameter region inserts the pin into the magazine tube and a second position in which the narrower diameter region allows the pin to retract from the magazine tube.

6. The shotgun of claim 3, wherein the shell follower is a tube that includes an open end and a closed end, wherein the closed end is oriented toward the shells when inserted into the magazine tube, and wherein the open end is oriented toward a forward end of the magazine tube when inserted into the magazine tube.

7. The shotgun of claim 6, wherein the open end of the shell follower contains at least a portion of a magazine return spring.

8. The shotgun of claim 3, wherein the shotgun further comprises:

an extension tube configured to provide an extension to the magazine tube; and an extension locking assembly configured to connect the extension tube to the magazine tube and hold the extension tube in concentric alignment with the magazine tube.

9. The shotgun of claim 8, wherein the extension locking assembly comprises:

an extension retaining ring configured to slide over a threaded open end of the magazine tube;

a barrel locking collar configured to insert into the extension retaining ring and threadably connect to the threaded open end of the magazine tube; and an extension locking ring configured to slide over the extension tube and threadably connect to the extension retaining ring to secure the extension tube to the magazine tube.

10. The shotgun of claim 9, wherein the barrel includes a downwardly-extending ring that slides over the magazine tube.

11. The shotgun of claim 10, wherein the extension retaining ring includes a shoulder that abuts the downwardly-extending ring of the barrel when the extension retaining ring is connected to the magazine tube, and wherein the barrel locking collar tightens the shoulder against the downwardly-extending ring when the barrel locking collar is threadably connected to the threaded open end of the magazine tube.

12. The shotgun of claim 10, wherein the extension retaining ring includes the obstruction and the selector device.

* * * * *